United States Patent [19]

McEvoy et al.

[11] Patent Number: 4,872,717

[45] Date of Patent: Oct. 10, 1989

[54] STRIKE PLATE REINFORCING DEVICE

[76] Inventors: Richard J. McEvoy, Box 383, Manotick, Canada, K0A 2N0; Robert A. Close, 61 McEwen Ave., #702, Ottawa, Canada, K2B 5L3

[21] Appl. No.: 174,303

[22] Filed: Mar. 28, 1988

[51] Int. Cl.[4] ..... E05B 15/02

[52] U.S. Cl. ..... 292/340; 292/DIG. 53

[58] Field of Search ..... 292/341.18, 341.19, 292/346, 340, DIG. 53

[56] References Cited

U.S. PATENT DOCUMENTS

| | | | |
|---|---|---|---|
| 1,094,290 | 4/1914 | Ames | 292/341.19 |
| 1,250,650 | 12/1917 | Pilchard | 292/341.19 |
| 2,127,891 | 8/1938 | Starling | 292/346 |
| 2,533,396 | 12/1950 | Payne | 292/340 |
| 2,884,277 | 4/1959 | Hale | 292/341.18 |
| 3,764,173 | 10/1973 | Griffith | 292/346 |
| 3,888,530 | 6/1975 | Fabrici | 292/346 |
| 4,005,890 | 2/1977 | Murch | 292/346 |
| 4,105,235 | 8/1978 | Thiel | 292/341.18 |
| 4,369,994 | 1/1983 | Vorves | 292/340 |
| 4,453,751 | 6/1984 | Hamilton | 292/340 |
| 4,474,394 | 10/1984 | Crepinsek | 292/340 |

*Primary Examiner*—Gary L. Smith
*Assistant Examiner*—Eric K. Nicholson
*Attorney, Agent, or Firm*—Barrigar & Oyen

[57] ABSTRACT

A doorjamb strike plate reinforcing device to provide increased holding strength and, therefore, security to bolted doors and similar closures. A reinforcing device is provided having a rigid body configured for cooperating with a strike plate to laterally restrain a bolt received by the strike plate. Integral to the body of the device is fastening means for fastening a fastener thereto to secure the device to the doorjamb. The fastening means is configured for receiving a fastener from a direction above the device and for guiding the passage of the fastener into the doorjamb in a direction which is at an angle of less than 25 degrees to the plane defined by the strike plate and, preferably not greater than 10 degrees so as to provide for the anchoring of the device and strike plate in a direction which is substantially parallel to the line of force which would be exerted thereon during an attempt to forcefully open a bolted door.

6 Claims, 1 Drawing Sheet

STRIKE PLATE REINFORCING DEVICE

FIELD OF THE INVENTION

A reinforcing device for reinforcing a doorjamb strike plate to provide greater security against attempted forceful openings of bolted doors and similar closures. More particularly, there is provided a strike plate reinforcing device which is secured to a doorjamb by means of a fastener held in the doorjamb in a direction substantially parallel to the plane defined by the strike plate and opposing the direction of a force applied against the door.

BACKGROUND

The conventional means of configuring a door frame for accommodating a door bolt is to cut out a bolt indentation in the door frame to align with, receive and surround a door bolt when the door is closed and the bolt is in an extended (i.e. locked) position. As well, a larger, shallower indentation in the shape of a strike plate is cut out around and over the bolt indentation to receive a strike plate in such manner that the strike plate lies flush with the surface of the door frame and does not obstruct the closing of the door. The strike plate is conventionally secured to the doorjamb by means of screws driven into the doorjamb in a direction perpendicular to the plane defined by the strike plate.

However, a strike of the above conventional configuration, while being structurally simple, has the disadvantage of being fairly weak and is unable to withstand high lateral forces such as that which is caused when a strong force is applied against bolted door (the bolt extending through the strike plate). This is because the conventionally used means of securing the strike plate to the doorjamb namely, by way of perpendicularly directed screws, produces a restraining force which necessarily runs perpendicular (rather than in opposition) to the line of force exerted against the door upon an attempt to force open the door against the resistance of the door bolt lying within the doorjamb and strike plate. Moreover, the grain of the wood used to construct the doorjamb is usually such as to lie in the direction of the plane of the strike plate thereby causing a tendency of the doorjamb below the strike plate to split apart from remainder of the doorjamb when a strong force is exerted against a bolted door in an attempt to forcefully open the door.

An attempt has previously been made to provide a strike structure which overcomes the above disadvantages by using elongated strike support members which are driven horizontally through the doorjamb below the strike plate and anchored to the strike plate as taught in U.S. Pat. No. 4,453,751 which issued on June 12, 1984 to Hamilton. However, the overall configuration and installation requirements of the Hamilton strike plate support structure have been found to be unacceptable to building contractors and the like in the industry because it requires the drilling of holes in the visible outer side of the doorjamb (thereby making the installation unattractive) and complicated manoeuvring on the part of the installer to align the threaded apertures of the support member with the strike plate fasteners.

The invention herein disclosed and claimed overcomes the above disadvantages of the Hamilton strike structure and provides a strike plate reinforcing structure which is anchored to the doorjamb in a direction which opposes a force applied to a bolted door to provide greater strength to a door strike.

SUMMARY OF THE INVENTION

In accordance with the invention there is provided a strike plate reinforcing device for reinforcing a doorjamb strike plate. The body of the reinforcing device is rigid and configured for cooperating with a strike plate to laterally restrain a bolt received by the strike plate. The body of the reinforcing device comprises a plate. Fastening means integral to the body of the reinforcing device is included for fastening a fastener thereto to secure the reinforcing device to a doorjamb. The plate is configured for installation between a strike plate and a doorjamb. The fastening means is configured to receive a fastener from above the plate and to permit passage of the fastener into the doorjamb in a direction which is at an angle of less than 30 degrees to a plane defined by the strike plate. Preferably, the direction of the passage of the fastener into the doorjamb is substantially parallel to the plane defined by the strike plate, for example, an angle thereto of 10 degrees or less is satisfactory to achieve substantially parallel anchoring for the purposes and objectives of the present invention.

The plate of the body of the reinforcing device is preferably of corresponding size and shape to the strike plate, includes a centrally located bolt opening and, on two sides thereof, fastener openings corresponding to bolt and fastener openings, respectively, in the strike plate. Preferably, the body of the device includes a raised border edge along an inner length thereof adjacent the plate such that the strike plate, when installed, fits directly over the plate and adjacent the raised border edge. The fastening means of the device preferably comprises at least one passageway formed in and at the intersection of the plate and raised border edge for receiving and guiding a fastener. For some applications it may be desired to attach a rigid basket to the device below the centrally located bolt opening in the plate.

A preferred embodiment of the invention is described in detail below with reference to the following drawings in which like reference numerals refer to like elements throughout.

DETAILED DESCRIPTION OF A PREFERRED EMBODIMENT

Figure 1:
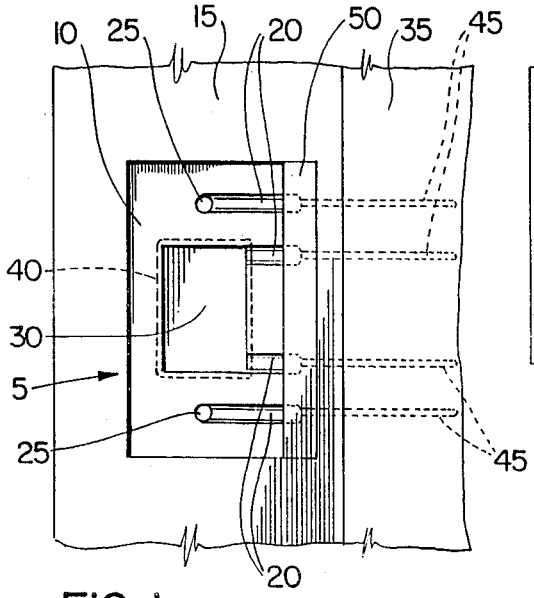
FIG. 1 is a front view of a doorjamb in the strike area of the doorjamb showing installed therein a strike plate reinforcing device in accordance with the invention (but not showing a strike plate).
Figure 2:
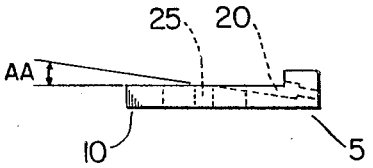
FIG. 2 is an end view of the strike plate reinforcing device shown in FIG. 1.
Figure 3:
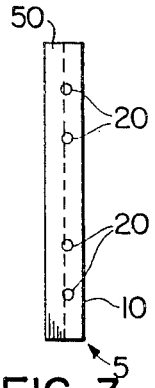
FIG. 3 is a side view of the strike plate reinforcing device shown in FIG. 1.

A preferred embodiment of the strike plate reinforcing device of this invention is illustrated in FIGS. 1–3 of the drawings. FIG. 1 shows a front view of a reinforcing device 5 installed in a doorjamb 15 in the strike area adjacent the jamb stop 35. FIGS. 2 and 3 show end and side views, respectively, of the reinforcing device.

Figure 1A:
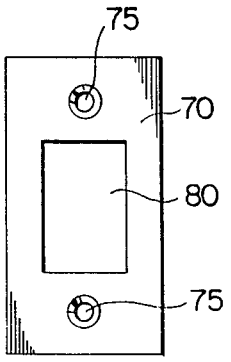
FIG. 1A is a front view of a conventional strike plate of the type contemplated to be installed over the reinforcing device shown in FIG. 1.

The body of the reinforcing device 5 is rigid, preferably made of strong metal, and includes a plate 10 and a raised border edge 50 along the inner length of the device 5. Fastening means 20, integral to the body of the device 5, each being a passageway formed in the plate 10, are provided for fastening fasteners to the device 5 to secure the device 5 to the doorjamb 15, 35. A centrally located bolt opening 30 is formed in the plate 10 and corresponds in position and approximate size to the position and size of the corresponding bolt opening (indentation) 40 in the doorjamb 15 and also the bolt opening 80 in the strike plate 70 illustrated in FIG. 1A, which together cooperate to receive and laterally restrain a door bolt. On each side of the central opening 30, along the central longitudinal axis of the plate 10, fastener openings 25 are formed in the plate 10 corresponding in position to similar fastener openings 75 in a conventional strike plate 70.

As is best shown by FIG. 2, the passageways 20 providing fastening means, are formed in and at the intersection of the plate 10 and the raised border edge 50. Each passageway 20 is sloped at an angle "AA" to the plane defined by the strike plate 70 when it is installed over the reinforcing device 5. The angle "AA" is such as to permit a fastener (e.g. a screw) to be directed through each passageway 20 from a direction above the device 5. Each passageway 20 serves to receive a fastener from such an upwardly direction and to guide the passage of the fastener into the doorjamb 15, 35 in a direction which is at an angle "AA" to the plane of the strike plate 70 (when installed).

In the preferred embodiment of the invention the angle "AA" is selected to be 10 degrees. A 10 degree angle is sufficient to enable the installer to locate the fasteners into the passageways 20 without significant obstruction caused from the surfaces of the plate 10 and doorjamb 15 yet is sufficiently small to provide for an anchoring of the reinforcing device 5 and strike plate 70 in a direction which is substantially parallel to the line of force which would be exerted on the device/strike plate during an attempt to forcefully open a bolted door. Other small angles of less than about 25 degrees might be used in the alternative but bearing in mind and taking into account the need for sufficient working room to install the fasteners in the passageways 20 and the objective of providing means for fastening the device 5 to the doorjamb 15, 35 through a line which substantially opposes the line of force resulting from a force exerted on the bolted door.

To install the reinforcing device 5, a cutout is formed in the doorjamb 15 in the strike area in the usual manner required for the installation of a strike plate but, in order to accommodate a reinforcing device 5 in addition to the strike plate a suitably increased depth and width are cut out—the required increases depending upon the thickness and width of the device 5 (specifically, the thickness and width of the plate 10 and the width of the raised border edge 50). As is conventionally done, a bolt opening 40 of suitable depth is cut out of the door jamb to receive a door bolt. The reinforcing device 5 is then placed into the cut-out formed in the doorjamb 15 to align the bolt openings 30 and 40. The device 5 is positioned such that the raised border edge 50 is placed adjacent the doorjamb stop 35 and preferably meets, at the top surface, the surface of the doorjamb 15 so as to provide an overall smooth surface in the strike area after the installation of the device 5 and strike plate 70.

Openings 45 are formed in the doorjamb 15, 35 in the direction of each passageway 20 (and, also, aligning and in the direction of the fastener openings 25) so as to securely accommodate fasteners such as screws. Then appropriate fasteners are installed in passageways 20 into openings 45 to secure the device 5 to the doorjamb 15, 35. Preferably, the fasteners used are fairly long and thin screws with small heads the length of which is illustrated by the length of the openings 45 produced in the doorjamb 15, 35. (A greater screw length provides greater strength to the installation of the device 5 and a thin small head facilitates the installation of the device and permits a compact installation). Following this, the strike plate 70 is installed over the reinforcing device 5 by aligning the strike plate fastener and bolt openings 75 and 80 with openings 25 and 30, respectively, of the device 5 and installing screws through the fastener openings 25 and 75 to secure the strike plate 70 over the plate 10 of the device 5 and adjacent to the raised border edge 50 of the device 5.

Figure 4:
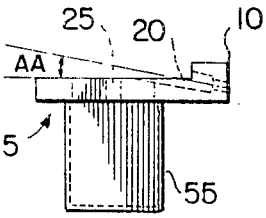
FIG. 4 is an end view of another embodiment of a strike plate reinforcing device in accordance with the invention.
Figure 5:
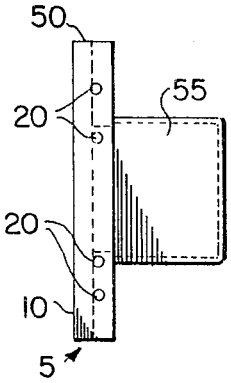
FIG. 5 is a side view of the strike plate reinforcing device shown in FIG. 4.

FIGS. 4 and 5 of the drawings show an embodiment of the reinforcing device 5 of the invention in which a rigid basket 55 extends below the plate 10 and around the central opening 30. The basket 55 is preferably made of a strong metal and may be used to provide for additional security to the reinforcing device 5. The basket 55 serves to encase the door bolt when a bolt is inserted into the openings 30, 40, 80 and protects the area of the bolt from damage from a line of direction emanating from behind the strike area through the doorjamb 15, 35 for example, a break-in in which a tool such as a screw driver or similar tool is used to damage the strike area of the doorjamb from outside (i.e. from behind the doorjamb and door).

The embodiments of the invention described above are those which are preferred by the inventors, however, variations may be made in respect of the various elements disclosed above while still coming within the scope of the invention, the definition of which is provided by the appended claims.

What is claimed is:

1. A reinforcing device for reinforcing a doorjamb strike plate, said reinforcing device comprising a rigid body whereby said body is configured for cooperating with said strike plate, said body including a plate and means integral to said body for fastening a fastener thereto to secure said reinforcing device to a doorjamb, whereby said plate is configured for installation between said strike plate and said doorjamb and said fastening means is configured for receiving a fastener and for permitting passage of said fastener into said doorjamb in a direction which is at an angle of less than 25 degrees to a plane defined by said strike plate, wherein said fastening means comprises at least one passageway in said plate for receiving and guiding said fastener and said body further comprises a raised border edge along an inner length thereof adjacent said plate, said passageway being formed in and at an intersection of said plate and border edge.

2. A reinforcing device according to claim 1, wherein said plate of said body is of corresponding size and shape to said strike plate, said plate further comprising a centrally located bolt opening and, on two sides thereof, fastener openings corresponding to bolt and fastener openings in said strike plate whereby said strike plate is able to fit directly over said plate and adjacent said raised border edge when said reinforcing device is installed.

3. A reinforcing device according to claim 2, wherein said reinforcing device further comprises a rigid basket below said centrally located bolt opening of said plate.

4. A reinforcing device for reinforcing a doorjamb strike plate, said reinforcing device comprising a rigid body whereby said body is configured for cooperating with said strike plate, said body including a plate and means integral to said body for fastening a fastener thereto to secure said reinforcing device to a doorjamb, whereby said plate is configured for installation between said strike plate and said doorjamb and said fastening means is configured for receiving a fastener and for permitting passage of said fastener into said doorjamb in a direction which is at an angle of less than 10 degrees to a plane defined by said strike plate, wherein said fastening means comprises at least one passageway in said plate for receiving and guiding said fastener and said body further comprises a raised border edge along an inner length thereof adjacent said plate, said passageway being formed in and at an intersection of said plate and border edge.

5. A reinforcing device according to claim 4, wherein said plate of said body is of corresponding size and shape to said strike plate, said plate further comprising a centrally located bolt opening and, on two sides thereof, fastener openings corresponding to bolt and fastener openings in said strike plate whereby said strike plate is able to fit directly over said plate and adjacent said raised border edge when said reinforcing device is installed.

6. A reinforcing device according to claim 5, wherein said reinforcing device further comprises a rigid basket below said centrally located bolt opening of said plate.

* * * * *